US009073720B2

(12) United States Patent
Beguin et al.

(10) Patent No.: US 9,073,720 B2
(45) Date of Patent: Jul. 7, 2015

(54) ARRANGEMENT FOR DRIVING A FLAT SUBSTRATE IN A PACKAGING PRODUCTION MACHINE

(75) Inventors: Boris Beguin, Fechy (CH); Philippe Clement, Penthalaz (CH)

(73) Assignee: BOBST MEX SA (CH)

( * ) Notice: Subject to any disclaimer, the term of this patent is extended or adjusted under 35 U.S.C. 154(b) by 955 days.

(21) Appl. No.: 13/133,420

(22) PCT Filed: Nov. 12, 2009

(86) PCT No.: PCT/EP2009/008072

§ 371 (c)(1),
(2), (4) Date: Jun. 8, 2011

(87) PCT Pub. No.: WO2010/066325

PCT Pub. Date: Jun. 17, 2010

(65) Prior Publication Data

US 2011/0240707 A1 Oct. 6, 2011

(30) Foreign Application Priority Data

Dec. 8, 2008 (EP) ..... 08021265

(51) Int. Cl.
*B65H 20/04* (2006.01)
*B65H 27/00* (2006.01)
*B65H 20/02* (2006.01)

(52) U.S. Cl.
CPC ..... *B65H 20/02* (2013.01); *B65H 20/04* (2013.01); *B65H 27/00* (2013.01);
(Continued)

(58) Field of Classification Search
CPC ..... B65H 20/02; B65H 20/04; B65H 20/24; B65H 20/34; B65H 27/00; B65H 2301/44318; B65H 2404/1316; B65H 2404/13161; B65H 2404/1321; B65H 2404/52131; B65H 2601/25; B65H 2601/251; B65H 2601/2532
USPC ..... 226/1, 180, 183, 185, 190, 194
See application file for complete search history.

(56) References Cited

U.S. PATENT DOCUMENTS 1,648,990 A * 11/1927 Little ..... 242/530
4,060,187 A * 11/1977 Grob ..... 226/8

(Continued)

FOREIGN PATENT DOCUMENTS

CH 605462 9/1978
CH 618660 12/1978

(Continued)

OTHER PUBLICATIONS

International Search Report dated May 18, 2010, issued in corresponding international application No. PCT/EP2009/008072.

*Primary Examiner* — William E Dondero
(74) *Attorney, Agent, or Firm* — Ostrolenk Faber LLP

(57) ABSTRACT

An arrangement (11) for driving a flat substrate along a longitudinal direction, the arrangement being mounted in a packaging production machine. The substrate has a surface that has sustained at least one modification. The arrangement includes a device (9) for driving the substrate along the longitudinal direction, and a device for bearing the substrate against the driving device (9), and having at least one bearing zone (23) facing toward the driving device (9). The substrate is engaged and driven between the driving device (9) and the bearing device. The bearing zone (23) has a transverse dimension (D) and position (Y), chosen as a function of a transverse dimension and a position of the modification on the substrate, so as to prevent damaging the modification between the driving device (9) and the bearing device.

8 Claims, 3 Drawing Sheets

(52) U.S. Cl.
CPC ..... *B65H 2301/44318* (2013.01); *B65H 2404/13161* (2013.01); *B65H 2404/52131* (2013.01); *B65H 2601/251* (2013.01); *B65H 2601/2532* (2013.01); *B65H 2404/1321* (2013.01); *B65H 2601/25* (2013.01)

(56) References Cited

U.S. PATENT DOCUMENTS

| | | | | |
|---|---|---|---|---|
| 4,244,504 | A | 1/1981 | Grob et al. | |
| 4,863,086 | A * | 9/1989 | Armelin | 226/152 |
| 5,398,604 | A | 3/1995 | Burke et al. | |
| 5,595,335 | A * | 1/1997 | Borel | 226/42 |
| 5,727,724 | A * | 3/1998 | Dowling | 226/181 |
| 6,533,154 | B2 * | 3/2003 | Kitai et al. | 226/177 |
| 6,602,176 | B1 * | 8/2003 | Ganneval | 493/405 |
| 2002/0113355 | A1 | 8/2002 | Lange et al. | |
| 2004/0050895 | A1 | 3/2004 | Zweifel et al. | |
| 2006/0175372 | A1 * | 8/2006 | Brost et al. | 226/3 |
| 2007/0057005 | A1 * | 3/2007 | Theilacker | 226/174 |

FOREIGN PATENT DOCUMENTS

| | | | |
|---|---|---|---|
| DE | 4340915 | A1 | 8/1994 |
| EP | 0835836 | A | 4/1998 |
| EP | 1378475 | A | 1/2004 |
| FR | 2816603 | A | 5/2002 |
| GB | 265343 | A | 2/1927 |
| GB | 1496103 | | 12/1977 |

* cited by examiner

ARRANGEMENT FOR DRIVING A FLAT SUBSTRATE IN A PACKAGING PRODUCTION MACHINE

CROSS-REFERENCE TO RELATED APPLICATIONS

The present application is a 35 U.S.C. §§371 national phase conversion of PCT/EP2009/008072, filed Nov. 12, 2009, which claims priority of European Application No. 08021265.7, filed Dec. 8, 2008, the contents of which are incorporated by reference herein. The PCT International Application was published in the French language.

BACKGROUND OF THE INVENTION

The present invention relates to an arrangement for driving a flat substrate. Such an arrangement is mounted in a packaging production machine. The invention also relates to a packaging production machine incorporating a station for feeding a converting unit with a flat substrate and the subsequent unit for converting the substrate. Such a unit for converting the substrate is a diecutting platen press or else a printing platen.

A packaging production machine is designed for the manufacture of boxes, that will be suitable for forming packages, by folding and gluing. In a packaging production machine, production begins with an initial flat substrate, that is to say for example a continuous substrate, such as a virgin web of cardboard. This substrate is unwound continuously, printed by one or more printing units, optionally embossed, and then cut in a diecutting platen press.

The blanks or boxes obtained are then shingled before being stacked in rows in order to form stacks in a delivery and palletizing station for the purpose of being stored or being conveyed out of the production machine.

The packaging production machine comprises several driving arrangements. The substrate must be driven, either in a continuous manner, or in a discontinuous manner, if the converting unit requires a momentary stop in the progression of the substrate during the conversion.

DESCRIPTION OF THE PRIOR ART

Documents CH-602,462 and CH-618,660 disclose a feeding station for a platen press, comprising a feathering drive leading the substrate around the circumference of an off-center roller mounted between two rotary plates. A pulling member is mounted upstream of the feathering drive that is designed to continually feed this feathering drive. The pulling member comprises a pulling roller over which the web substrate passes and a pressure roller.

An infeed member is mounted downstream of the feathering drive which is designed to feed the platen press. The infeed member comprises a driven bottom roller and a set of pressure belts that can be raised on command so as to cancel out the pulling effect applied to the substrate. The pulling member and the infeed member are provided for driving the flat cardboard.

However, these two members are not suitable for driving substrates that have a fragile surface or a surface that must not be damaged. Such surfaces are particularly attractive for the consumer who buys the product with its final packaging. The packaging manufacturer therefore seeks to promote the product by virtue of the packaging. This means that such modifications to the exposed surface of the substrate must not sustain damage throughout the packaging production process.

SUMMARY OF THE INVENTION

A main object of the present invention consists in developing an arrangement for driving a flat substrate. A second object is to produce a driving arrangement specifically for a substrate of which the surface has one or more modifications forming one or more delicate zones. A third object is to associate a driving of a substrate at high speed with a conservation of the integrity of this same substrate. Yet another object is that of creating a packaging production machine comprising a converting unit and a feeding station for feeding the converting unit with a substrate having an arrangement for driving the substrate.

The invention concerns an arrangement for driving a flat substrate along a longitudinal direction. The arrangement is mounted in a packaging production machine. The flat substrate has a surface that has sustained at least one modification. The arrangement comprises:

- means for driving the substrate along the longitudinal direction, and
- means for bearing this substrate against the driving means, having at least one bearing zone facing toward these driving means, this substrate being able to be engaged between these driving means and the bearing means and driven by these driving means and bearing means.

According to one aspect of the present invention, the arrangement is characterized in that the bearing zone has a transverse position and a transverse dimension, chosen as a function of a transverse position and a transverse dimension of the modification, so as to prevent damaging this modification between these driving means and bearing means.

In the whole of the description, the substrate is defined, as a nonexhaustive example, as being in the form:

- of a web substrate, for example
- of paper, or cardboard, or plastic, such as polyethylene terephthalate (PET), bi-oriented polypropylene (BOPP), or other polymers, or aluminum, or of other materials, or in the form
- of a sheet or plate substrate, for example
- of flat board, or corrugated cardboard, or else a flexible material, such as polyethylene (PE), or of yet other materials, or in the form
- of a substrate in the form of boxes or blanks, originating from a cutting in a diecutting platen press or in a rotary diecutter.

The flat substrate has sustained at least one first earlier process for modifying its surface. The modification on the surface is defined as a nonexhaustive example, as being:

- a printing, in the course of which one or more colors have been applied to the surface of the substrate, in order to place thereon graphic signs and/or in order to give it an attractive appearance; and/or
- a layer of varnish or of a polymer material fusible at low temperature, covering all or some of the surface of the substrate; and/or
- a scoring, an embossing, a structuring of the surface of the substrate; and/or
- a hot stamping, also known as "hot foil stamping", on the surface of the substrate; and/or
- a label or a hologram bonded to the surface of the substrate; and/or
- yet other modifications conferring a partial or total fragility of the surface of the substrate.

The modification or modifications are localized or repetitive over the whole surface of the substrate. The modification is on only one side of the flat substrate or it is on both sides.

The longitudinal direction is defined by referring to the median axis of the machine of which the direction is determined by that of the driving of the substrate. The transverse direction is defined as being the direction perpendicular to the driving direction of the substrate.

In other words, in order to protect the substrate and its surface, the bearing means present only one or a series of interruptions in the transverse direction. This or these interruptions have one or more positions in the transverse direction corresponding to one or more positions in the transverse direction of the modification or modifications. Furthermore, this or these interruptions have one or more dimensions in the transverse direction corresponding to one or more dimensions of the modification or modifications in the transverse direction.

At the interruption or interruptions, there is no contact between the bearing zone and the substrate. In this manner, the bearing zone is placed beside the modification or modifications. By its positioning at the bearing means, the bearing zone will not crush or damage the modification or modifications. This positioning of the bearing zone is all the more important the higher the speed of the driving means, of the arrangement for driving the substrate and of the whole packaging production machine.

According to another aspect of the present invention, a packaging production machine, comprising a converting unit and a station for feeding the converting unit with a web substrate, is characterized in that it comprises at least one arrangement having one or more of the technical features described below and in the claims. The arrangement or arrangements are installed upstream or downstream of the converting unit and/or upstream or downstream of the feeding station.

BRIEF DESCRIPTION OF THE DRAWINGS

The invention will be clearly understood and its various advantages and features will better emerge from the following description of the nonlimiting exemplary embodiment, with reference to the appended schematic drawings in which.

DETAILED DESCRIPTION OF PREFERRED EMBODIMENTS

Figure 1:
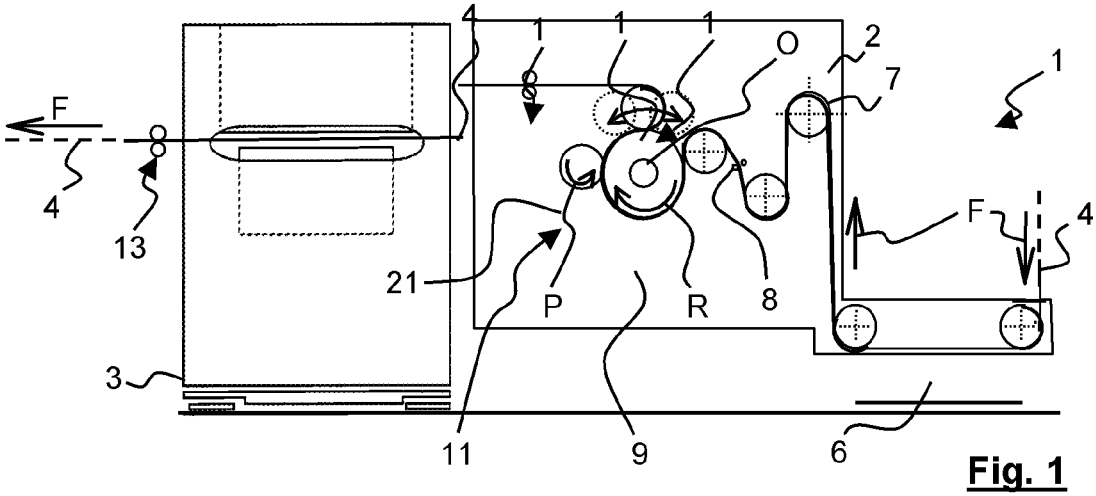
FIG. 1 represents a synoptic side view of a feeding device and of a diecutting platen press fitted with three driving arrangements according to the invention.
Figure 2:
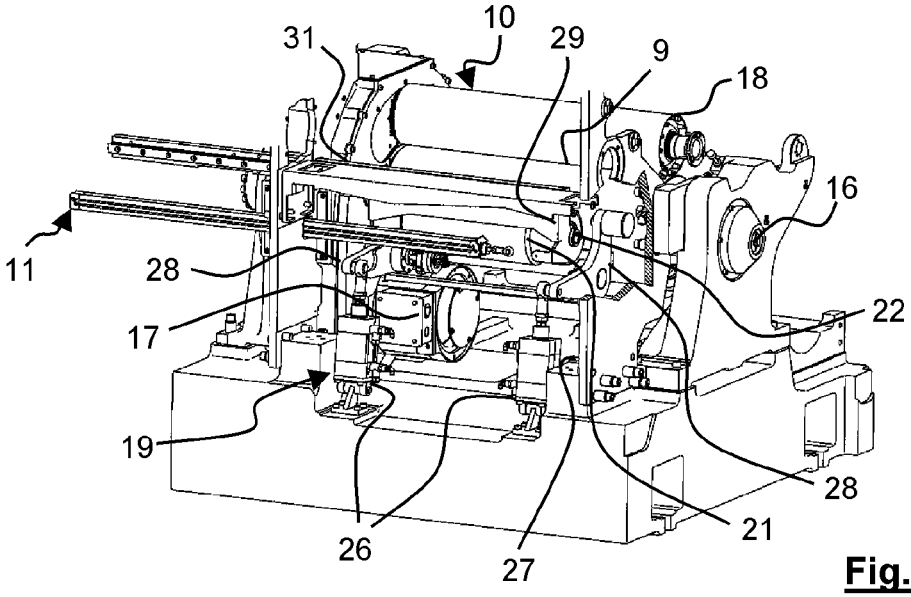
FIG. 2 represents a partial view in perspective of a driving arrangement according to a first embodiment.

As illustrated in FIG. 1, a packaging production machine (1) comprises particularly a feeding station (2) and a converting unit which, in this case, is a diecutting platen press (3). The feeding station (2) receives upstream a web substrate or material which, in this case, is cardboard (4), arriving at a constant speed. The web (4) arrives in the feeding station (2) and in the press (3) with a modification (not visible in the figures) on its surface.

The packaging production machine (1) has upstream from the feeding station (2), as an example, printing units, means for monitoring the quality and the register, as well as means for embossing or any other means (not shown) for modifying the surface of the web (4).

Figure 3:
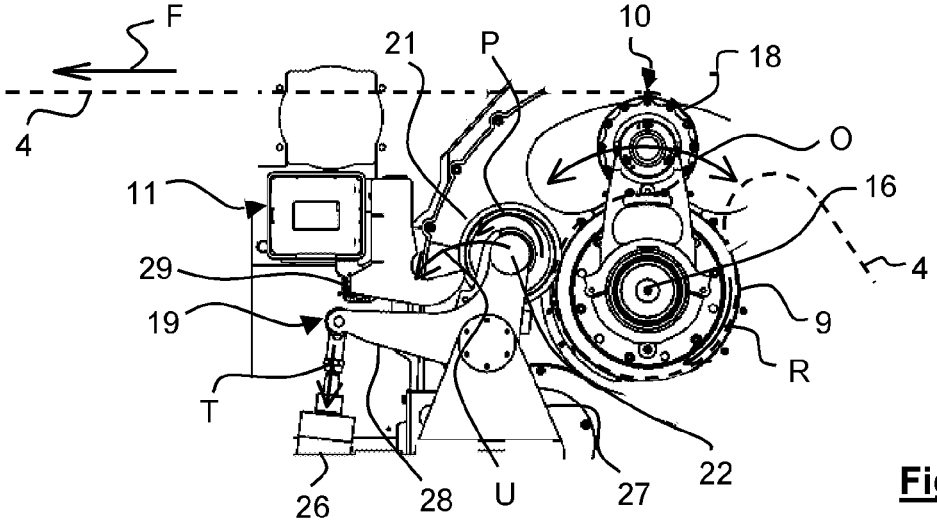
FIG. 3 represents a partial side view of the arrangement of FIG. 2, with bearing means in a driving position.
Figure 4:
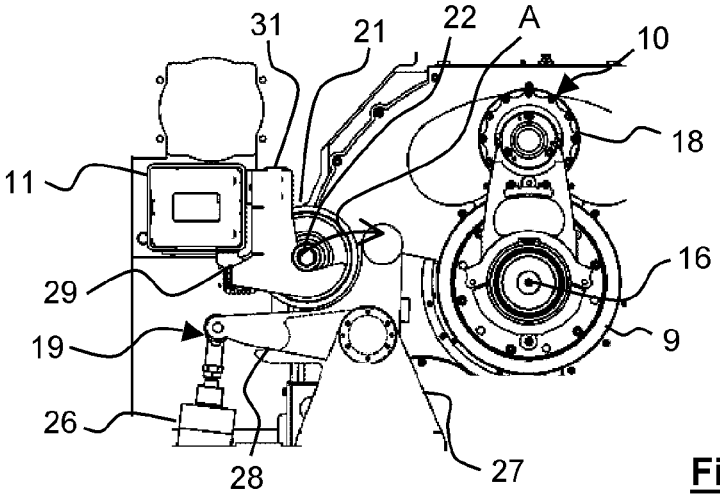
FIG. 4 represents a partial side view of the arrangement of FIG. 2, with the bearing means in a out-of-driving position.

The feeding station (2) delivers this same web (4) downstream to the platen press (3) at an intermittent speed. The platen press (3) cuts the web (4) and delivers the substrate in the form of blanks (5). The blanks (5) leave the press (3) with the modification (not visible in the figures) on their surface. The direction of travel or of progression (arrow F in FIGS. 1 and 3) of the web (4) and of the blanks (5) along the longitudinal direction indicates the upstream direction and the downstream direction.

In order to ensure an optimum operation of the press (3), the feeding station (2) may comprise, in order from upstream to downstream:

- a lateral web guiding (6), used for correcting the lateral register of the web (4) if necessary;
- a dancer roller (7), designed to set up a constant tension of the web (4), upstream from a feathering drive (9) and from a first driving arrangement (11);
- a web straightener (8), also known as a "decurler";
- the sensitive control (9) also known as the "feathering drive";
- a loop control (10);
- the first driving arrangement (11) for driving the web (4), according to a first embodiment of the invention, positioned against the feathering drive (9);
- a second driving arrangement (12) for driving the web (4) according to a second embodiment of the invention, positioned downstream from the feathering drive (9) and upstream from the platen press (3).

A third driving arrangement (13) for ejecting or exiting the blanks (5) from the press (3), according to the second embodiment of the invention, is positioned downstream from the platen press (3). The third arrangement (13) for driving the blanks (5), according to the second embodiment of the invention, is substantially similar to the second arrangement (12) for driving the web (4) according to the second embodiment of the invention.

The feathering drive is a main drive roller (9) rotating (arrow R in FIGS. 1 and 3) on a main shaft (16). The main shaft (16) and therefore the main roller (9) are mounted substantially horizontally and perpendicularly to the direction of progression of the web (4). The main roller (9) therefore continuously drives the web (4) from upstream to downstream. A main electric drive motor (17) drives rotatably the drive roller (9).

The loop control (10) comprises a satellite roller (18) mounted by being placed side-by-side parallel to the main roller (9). The web (4) is engaged between the main roller (9) and this satellite roller (18), and it is maintained there, while being able to be driven. The web (4) forms a path which covers approximately three-quarters of a circumference of the main roller (9) and half a circumference of the satellite roller (18).

The satellite roller (18) is able to oscillate (arrow O in FIGS. 1 and 3) about the main drive roller (9), from upstream to downstream, and vice versa from downstream to upstream. Two extreme positions of the satellite roller (18) are shown in dotted lines in FIG. 1.

The frequency of the oscillations (O) of the satellite roller (18) generates variations in the speed of the web (4). The web (4) changes cyclically from a constant speed to a zero speed, and vice versa, from a zero speed to a constant speed. These changes in speed and consequently the frequency of the oscillations (O) are chosen according to the cutting strike speed of the press (3) situated downstream.

The web (4) has a surface that has sustained at least one modification, for example an embossing. The embossing is obtained by an embossing unit positioned in the machine (1) upstream from the infeed station (2). Such an embossing creates bumps at the web surface (4).

According to the first embodiment (see FIGS. 1 to 5) and according to the second embodiment (see FIGS. 1 and 6 to 8) of the invention, the first, second and third arrangement (11, 12, 13) stabilize and drive respectively the web (4) and the blanks (5) along the longitudinal direction (F).

The first arrangement (11) may advantageously be placed upstream from the converting unit, in the form of the diecutting platen press (3), in a feeding station (2) for this press (3).

The first arrangement (11) first of all comprises means for driving the web (4), along the longitudinal direction (F), preferably able to be formed by the main drive roller (9).

The first arrangement (11) then comprises means (19) for bearing the web (4) against the driving means, i.e. against the main roller (9). In a very advantageous manner, these bearing means (19) may comprise a pressure roller (21). This pressure roller (21) forms a rotary element pivoting (arrow P in FIGS. 1 and 3) on an axis (22), when the main drive roller (9) is rotatably driven (R) by the electric drive motor (17).

The web (4) is able to be engaged (see FIG. 3) between these drive means, the main roller (9), and the bearing means (19), the pressure roller (21), is able to be held and is able to be driven by these driving means and these bearing means (19).

Figure 5:
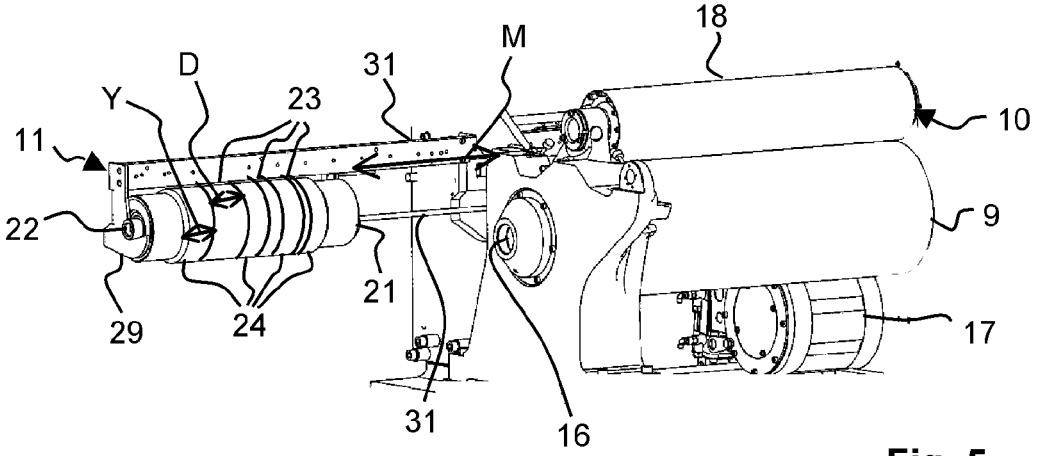
FIG. 5 represents a view in partial perspective of the arrangement of FIG. 2, with the bearing means in a transverse exit position.

As shown in FIG. 5, the pressure roller (21) may form all or some of a bearing zone, able to have at least one protrusion, for example five protrusions or bosses (23), separated by six recesses or concavities (24). When the pressure roller (21) is engaged against the main roller (9), the protrusions (23) define the bearing zone turned toward the main roller (9).

A transverse position (arrow Y in FIG. 5) and a transverse dimension (arrow D in FIG. 5) of the bearing zone, in this instance of each of the protrusions (23), and therefore of the recesses (24), can be chosen depending on the position and the transverse dimension of the modification that is present on the web (4). The transverse position (Y) may be defined with respect to the edge of the pressure roller (21).

In this manner, the recesses (24) are matched up with the modification of the web (4) and the protrusions (23) pass beside the embossing, i.e. beside the modification of the web (4). By the choice of pressure roller (21), the operator prevents damaging this modification between the pressure roller (21) and the main roller (9). By the appropriate match between the pressure roller (21) and the work done and the modification made upstream, the web (4) will be protected in the course of its driving.

In order to obtain a constant bearing, the bearing means (19) may comprise at least one pressure member (26), in the form of two side cylinders. The pressure member (26) can push (arrow T in FIG. 3) the rotary element, i.e. the pressure roller (21), against the driving means, i.e. the main roller (9).

The bearing means (19) may also preferably comprise a structure (27) to which the pressure member (26) can be attached. The bearing means (19) may also preferably comprise two side levers (28). The two levers (28) are located on each side of the pressure roller (21) and may be able to hold the pressure roller (21) by its axis (22) when this pressure roller (21) is in the active position and in operation. The two levers (28) may be able to pivot (arrow U in FIG. 3) relative to the structure (27). The two levers (28) may be able to pivot relative to the pressure member (26), in order to transmit the thrust (T) to the pressure roller (21).

The first arrangement (11) may advantageously comprise two side flanges (29). The two flanges (29) may be able to receive the pressure roller (21) when this pressure roller (21) is in the inactive position and is no longer in operation.

When there is a job change, the pressure in the pressure member (26) is released and the pressure roller (21) moves away from the main roller (9). The pressure roller (21) can therefore move from the active position (FIG. 3), positioned on the two levers (28), to an inactive position (FIGS. 2, 4 and 5), positioned on the two flanges (29), and vice versa (arrow A in FIG. 4).

The two flanges (29) may be mounted on a transverse ramp (31). The ramp (31) may be moved transversely, in order to be able to enter and exit the pressure roller (21) transversely (arrow M in FIG. 5), outside the feeding station (2), and thus outside the machine (1). To do this, the ramp (31) is divided into four portions, two top ramp portions sliding respectively relative to two bottom ramp portions.

The operator will be able to remove the old pressure roller (21) and insert a new pressure roller (21) with different features (Y and D) for the bearing protrusions (23), outside the feeding station (2) and the machine (1). In this manner, the ergonomics of the operation for changing the pressure roller (21) will be greatly improved for the operator.

The second arrangement (12) may advantageously be placed upstream from the converting unit, in the form of the diecutting platen press (3), in a feeding station (2) for this press (3). The third arrangement (13) may advantageously be placed downstream from the converting unit, in the form of the diecutting platen press (3).

The second and third arrangements (12 and 13) comprise first of all means for driving the web (4) and respectively blanks (5) along the longitudinal direction (F), which may preferably comprise a driving roller (32). The roller (32) may be rotatably driven (arrow R in FIGS. 6 and 7) by an electric drive motor (33). The motor (33) may be mounted coaxially with the roller (32).

The second and third arrangements (12 and 13) also comprise means (35) for bearing the web (4) and respectively blanks (5) against the driving means, i.e. against the roller (32). Very advantageously, these bearing means (35) may comprise only one or a series of pressure rollers (36), in this instance being six in number. These rollers (36) form a rotary element pivoting (arrow P in FIGS. 6 and 7) on an axis (37), when the roller (32) is rotatably driven (R) by the electric drive motor (33).

The web (4) or the blanks (5) are able to be engaged (see FIG. 7) between these driving means, i.e. the roller (32), and the bearing means (35), i.e. the rollers (36). The web (4) or the blanks (5) are able to be maintained and are able to be driven by these driving means and these bearing means (35).

Figure 6:
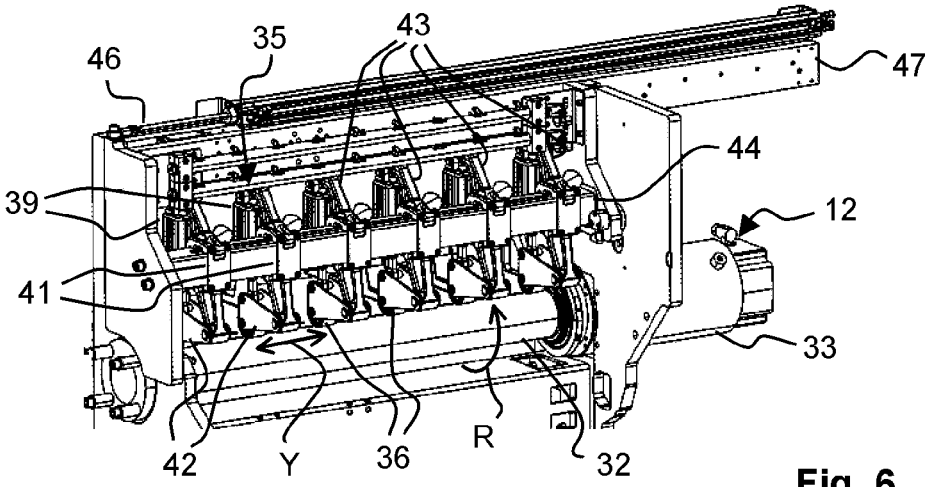
FIG. 6 represents a view in partial perspective of a driving arrangement according to a second embodiment, having six bearing subassemblies.
Figure 7:
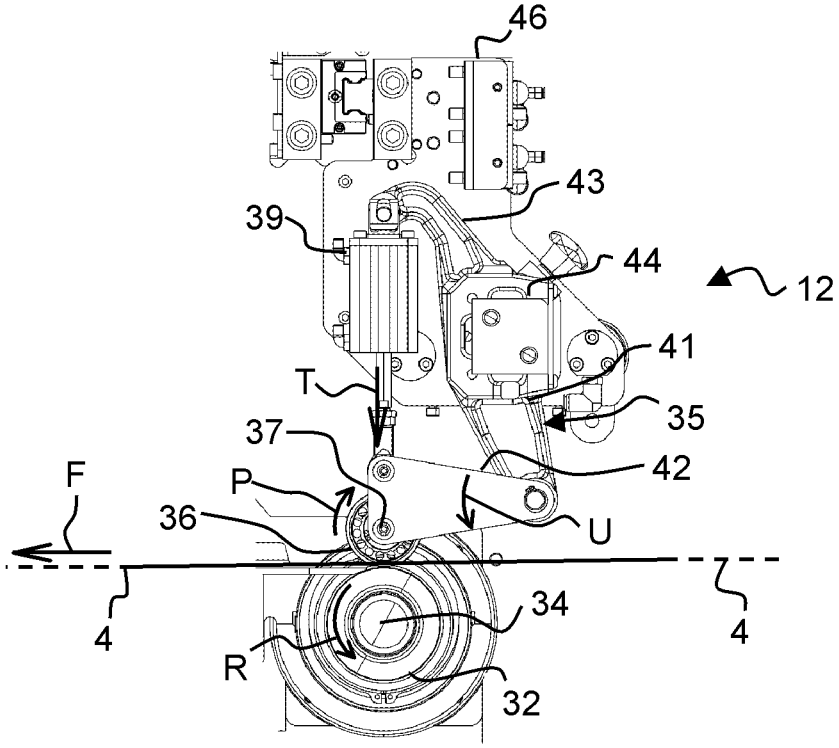
FIG. 7 represents a side view of a bearing subassembly of the arrangement of FIG. 6.
Figure 8:
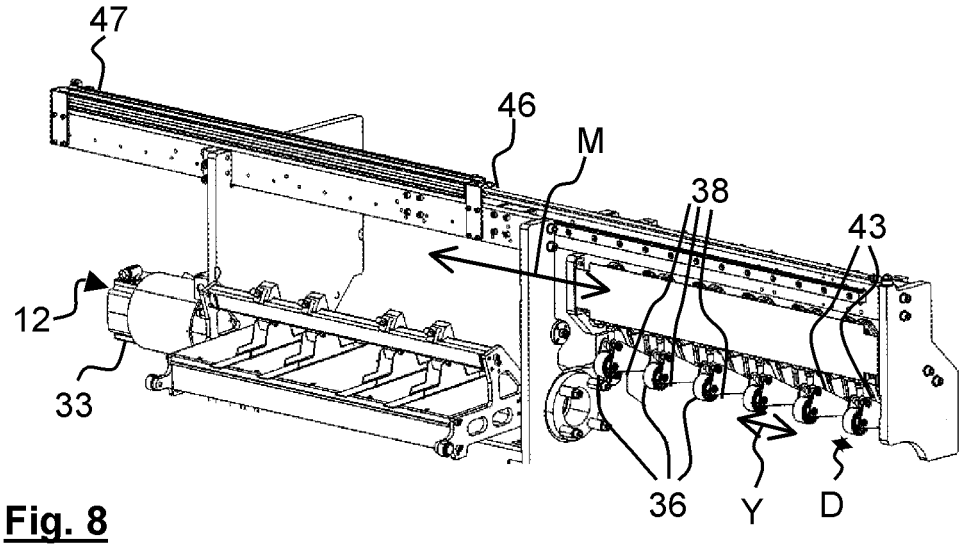
FIG. 8 represents a view in partial perspective of the arrangement of FIG. 6, with the bearing means in a transverse exit position.
Figure 1:
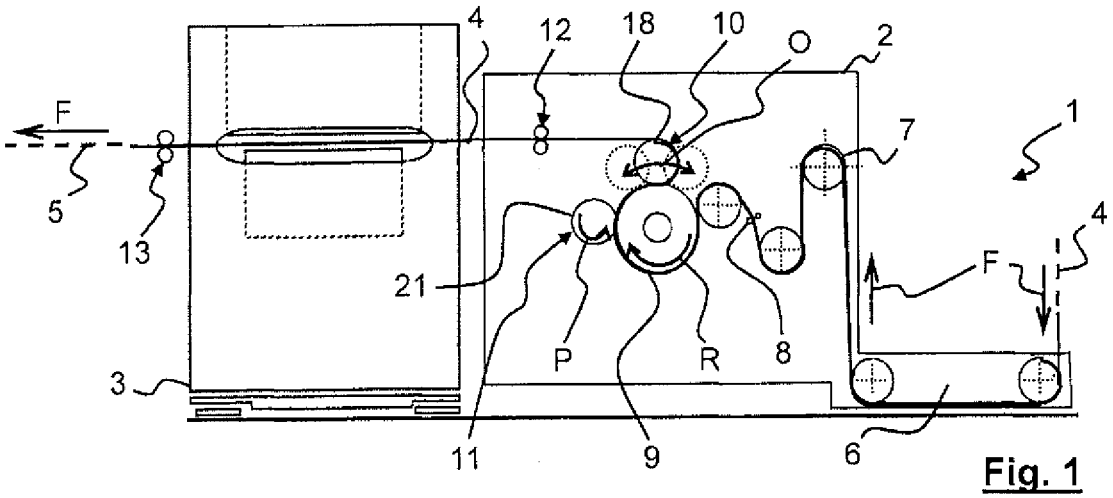

As shown in FIGS. 6 and 8, the rollers (36) may form all or some of the bearing zone, while being separated from one another by a gap (38). When the rollers (36) are engaged against the roller (32), the respective rolling surface of each of the rollers (36) defines the bearing zone turned toward the roller (32).

A transverse position (arrow Y in FIG. 6) and a transverse width (arrow D in FIG. 8) of the bearing zone, in this instance of each of the rollers (36), and thus of the gaps (38), can be chosen as a function of the position and the transverse dimension of the modification that is present on the web (4) or on the blanks (5). The transverse position (Y) may be defined relative to the edge of the first roller (36).

In this manner, the gaps (38) match up with the modification of the web (4) or blanks (5) and the rollers (36) run to the side of the embossing, or to the side of other modifications, i.e. to the side of the modification of the web (4) or blanks (5). By choosing the position and the width of each of the rollers (36), the operator prevents damaging this modification between the rollers (36) and the roller (32). By the appropriate match between the pinch rollers (36) and the job done and the modification made upstream, the web (4) or the blanks (5) will be protected as they are driven.

In order to obtain a constant pressure, the bearing means (35) may comprise at least one pressure member (39) in the form of a cylinder. The pressure member (39) can push (arrow T in FIG. 7) the rotary element, that is to say the roller (36), against the driving means, i.e. the roller (32).

The bearing means (35) may also preferably comprise a structure (41) to which the pressure member (39) can be attached. The bearing means (35) may also preferably comprise two side levers (42). The two levers (42) are located on each side of the roller (36) and may be able to hold the roller (36) by its axis (37). The two levers (42) may be able to pivot downward (arrow U in FIG. 7) relative to the structure (41), when this roller (36) is placed in active position and in operation. The two levers (42) may also be able to pivot relative to the pressure member (39) to transmit the thrust (T) to the roller (36).

During a change of job, the pressure in the pressure member (39) is released and the roller (36) moves away from the roller (32). The roller (36) may thus move from the active position (FIGS. 6 and 7) to an inactive position (FIG. 8), and vice versa.

In a favorable manner, the roller (36), the structure (41), the two levers (42) and the pressure member (39) may form a bearing subassembly (43) that can be set transversely. To do this, the structure (41) may be able to slide on a transverse ramp (44) so as to adjust the transverse position of the bearing subassembly (43) and thus of the roller (36).

The ramp (44) may be moved transversely, in order to enter and exit transversely (arrow M in FIG. 8) the bearing subassembly or subassemblies (43) with the roller or rollers (21), outside the feeding station (2), and thus outside the machine (1). To do this, the ramp (44) is mounted on another portion of ramp, namely a top portion of ramp (46) sliding respectively relative to another fixed portion of ramp (47).

The operator will be able to remove the old roller or rollers (36) and install one or more new rollers (36), with different features for the bearing widths (D), outside the feeding station (2) and outside the machine (1). The operator will be able to set the transverse position (Y) of each of the bearing subassemblies (43) and thus of each of the rollers (36). In this manner, the ergonomics of the operation for changing bearing subassembly (43) will be greatly improved for the operator.

The present invention is not limited to the embodiments described and illustrated. Many modifications can be made without however departing from the context defined by the scope of the set of claims.

The invention claimed is:

1. An arrangement for driving a generally flat substrate along a longitudinal direction pathway wherein, the substrate has a surface that has at least one modification or feature thereon, the arrangement comprising:

a driving apparatus for driving the substrate along the longitudinal direction of the pathway, and a bearing device for bearing the substrate against the driving apparatus, having at least one bearing zone facing toward the driving apparatus, the bearing zone being located on a rotary element, and being positioned to make contact with a region of the substrate located between two opposite edges of the substrate;

the bearing device comprising the rotary element and the rotary element forming all or some of the bearing zone, at least one pressure member configured and operable for pushing the rotary element against the driving apparatus, a supporting structure to which the pressure member is attached, and two side levers configured to disengageably hold the rotary element and being pivotable relative to the structure and relative to the pressure member, two side flanges configured to receive, disengaged from the two side levers, the rotary element from the two side levers and the flanges are mounted on a transverse ramp and are movable thereon transversely, in order to enable the rotary element to enter and exit transversely from outside the arrangement, wherein the driving apparatus and the bearing device are arranged to allow the substrate to be selectively engaged and driven to pass between the driving apparatus and the bearing zone of the bearing device;

wherein the bearing zone includes at least one interruption having a transverse dimension transverse to the longitudinal direction and a position that correspond to a transverse dimension and a position of the modification or feature, so as to prevent damaging the modification or feature between the driving apparatus and the bearing device by avoiding contact with the modification or feature and the rotary element comprises a pressure roller having at least one protrusion thereon and the pressure roller defining the bearing zone, with the position and the transverse dimension of the bearing zone selected according to the position and the transverse dimension of the modification or feature.

2. The arrangement according to claim 1 wherein the driving device comprises a roller rotated by an electric drive motor which is mounted coaxially with the roller.

3. The combination arrangement according to claim 1, wherein the arrangement is placed upstream from a converting unit, which is in the form of a diecutting platen press and wherein the substrate is a web of cardboard.

4. The arrangement according to claim 1, wherein the arrangement is placed downstream from a converting unit, which is in the form of a diecutting platen press and wherein the substrate is a blank.

5. A feeding station including the arrangement according to claim 1, the feeding station being configured and operable for feeding a converting unit, wherein the converting unit has the form of a diecutting platen press, and wherein the substrate is a web of cardboard.

6. A packaging production machine including the arrangement according to claim 1, the arrangement being placed upstream from a converting unit of the machine wherein the converting unit is in the form of a diecutting platen press, in a feeding station for the platen press configured and operable for feeding the converting unit, wherein the substrate is a web of cardboard.

7. A packaging production machine according to claim 6, wherein the driving apparatus comprises a feathering drive that is rotated by an electric drive motor.

8. A packaging production machine comprising:

a converting unit, a station for feeding the converting unit with a web substrate, at least one arrangement according to claim 1 installed upstream or downstream of the converting unit and/or of the feeding station.

* * * * *

UNITED STATES PATENT AND TRADEMARK OFFICE

CERTIFICATE OF CORRECTION

PATENT NO. : 9,073,720 B2
APPLICATION NO. : 13/133420
DATED : July 7, 2015
INVENTOR(S) : Boris Beguin and Philippe Clement It is certified that error appears in the above-identified patent and that said Letters Patent is hereby corrected as shown below:

In the Drawings,
Sheet 1, Fig. 1, the reference numeral 5 near the left-hand side of the figure should replace reference numeral 4 under the arrow F (reference numeral 5 depicts blanks that are exiting from the press (3)) as shown on attached sheet.

In the Specification,
At col. 6, line 54, "element pivoting (arrow P in FIGS. 6 and 7) on an axis (37)," should read -- element pivoting (arrow P in FIG. 7) on an axis (37), --.

Signed and Sealed this
Nineteenth Day of April, 2016

Michelle K. Lee

Michelle K. Lee
*Director of the United States Patent and Trademark Office*